US008141333B2

(12) United States Patent
Yu

(10) Patent No.: US 8,141,333 B2
(45) Date of Patent: Mar. 27, 2012

(54) CHAIN ASSEMBLING-DISASSEMBLING STRUCTURE

(75) Inventor: Min-Chi Yu, Taichung (TW)

(73) Assignee: Ho Chi Enterprises Co., Ltd., Taichung (TW)

( * ) Notice: Subject to any disclaimer, the term of this patent is extended or adjusted under 35 U.S.C. 154(b) by 165 days.

(21) Appl. No.: 12/693,067

(22) Filed: Jan. 25, 2010

(65) Prior Publication Data

US 2011/0179761 A1 Jul. 28, 2011

(51) Int. Cl.
*B21L 21/00* (2006.01)
*B25B 13/00* (2006.01)

(52) U.S. Cl. ..... 59/7; 59/35.1; 7/138; 29/243.53

(58) Field of Classification Search ..... 59/7, 11, 59/35.1; 7/138; 29/243.53
See application file for complete search history.

(56) References Cited

U.S. PATENT DOCUMENTS

| | | | | |
|---|---|---|---|---|
| 1,436,429 | A * | 11/1922 | Bean | 59/7 |
| 2,826,893 | A * | 3/1958 | Falk et al. | 59/7 |
| 5,140,736 | A * | 8/1992 | Hsiao | 29/243.54 |
| 5,463,862 | A * | 11/1995 | Reisenauer | 59/7 |
| 7,409,817 | B1 * | 8/2008 | Huang | 59/7 |
| 7,797,920 | B2 * | 9/2010 | Wang | 59/7 |

* cited by examiner

*Primary Examiner* — David Jones
(74) *Attorney, Agent, or Firm* — Muncy, Geissler, Olds & Lowe, PLLC

(57) ABSTRACT

A chain assembling-disassembling structure includes an assembling base, a first clamping component, a second clamping component, a penetrating shaft and a driving shaft. The assembling base has a fixing portion and the fixing portion has a concave edge for receiving a bushing of the chain section. And, the assembling base includes a first portion and a second portion vertically formed at two opposite ends thereof for respectively engaging with the first and second clamping components. Here, the first and second clamping components together clamp and restrict the chain. The second clamping component has a tubular shape for being inserted by the penetrating shaft, and then, the driving shaft can further be locked into the second clamping component. By turning the driving shaft, the penetrating shaft can be forced to push out a pin, which is used for jointing the inner and outer link plates of the chain.

6 Claims, 10 Drawing Sheets

CHAIN ASSEMBLING-DISASSEMBLING STRUCTURE

FIELD OF THE INVENTION

The present invention is related to a tool for assembling-disassembling a chain section of a chain, and more particularly to a tool for conveniently and rapidly assembling-disassembling a pin in the chain section.

BACKGROUND OF THE INVENTION

As shown in FIG. 1, the general chain includes plural inner link plates 1 and outer link plates 2 which are corresponding to each other. The outer link plates 2 are attached to the outer surfaces of the inner link plates 1, and a pin 3 penetrates through a bushing 4 between two outer link plates 2 and two inner link plates 1 with two ends exposed out of the outer sides of the two outer link plates 2. Here, one end of the pin 3 has a bolt head 5, and the other end also should be riveted after passing through two inner link plates 1, two outer link plates 2 and the bushing 4, so as to joint the inner and the outer link plates 1, 2 together.

However, when the chain is used in different applications, it always needs to change the number of link plates for varying the length of the chain. Therefore, for separating the link plates, the pin 3 for jointing should be punched out of the inner and the outer link plates 1, 2, and after the unneeded link plates are removed, the now adjacent link plates are connected with connecting plates 6 whose shape is similar to the outer link plate 2, so that the pin 3 can again pass through the connecting plates 6, the inner link plates 1 and the bushing 4 for fixing. Then, after the end portion of the pin 3 is riveted, the length changing process can be completed.

Conventionally, when disassembling the pin 3, an acicular object is always utilized to remove the pin 3, in which both the pin 3 and the outer link plates 2 would be punched and damaged, so that not only the cost for altering the length is increased but the operation also is difficult.

SUMMARY OF THE INVENTION

The object of the present invention is to provide a chain assembling-disassembling structure which can rapidly disassemble the chain by removing the pin for jointing the inner and outer link plates, and can re-assemble two adjacent chain sections after changing the length of the chain by riveting the end portion of the pin to re-joint the inner and outer link plates together. The chain assembling-disassembling structure includes an assembling base, a first clamping component, a second clamping component, a penetrating shaft and a driving shaft.

The assembling base has a horizontal bottom surface with a first portion and a second portion vertically formed at two opposite ends thereof, and a fixing portion is mounted at the middle of the assembling base, wherein the fixing portion has a concave edge at the top thereof.

The first clamping component is a screw tube with an inner channel and is transversely locked with the first portion of the assembling base.

The second clamping component is a hollow screw tube transversely locked with the second portion of the assembling base and includes a through hole thereinside and a screw hole at the outer side of the through hole.

As operating, a chain is positioned in the concave edge, and the penetrating shaft penetrates through the second clamping component and the through hole of the second clamping component, so that the inner end of the penetrating shaft can be corresponding to the outer end portion of the pin. Then, the driving shaft is locked with the screw hole of the second clamping component to force the penetrating shaft to move inward, thereby pushing the pin out of the chain.

When the chain section is disassembled, and the two adjacent chain sections are going to be assembled, the third clamping component is positioned in the concave edge and the frame trough of the fourth clamping component is used to accommodating a connecting plate, so that the chain can be positioned between the third clamping component and the fourth clamping component and the two adjacent inner link plates can be just corresponding to the connecting plate with the pins of the two inner link plates corresponding to the pin holes of the connecting plate. Here, by turning the second clamping component, the fourth clamping component can be forced to butt the chain, which is also pressed by the third clamping component. Then, the penetrating shaft penetrates through the through hole, so that the driving shaft can turned to push the penetrating shaft and thus force the penetrating shaft to press the fourth clamping component to move inward, thereby the two pin holes of the connecting plate sleeving the two pins of the two adjacent inner link plates.

Then, when it is going to rivet one end portion of the pin, the first pressing component is sleeved in the inner channel of the first clamping component and the second pressing component is sleeved in the through hole of the second clamping component, so that by turning the first clamping component and the second clamping component, the two ends of the pin can be respectively pressed, wherein one end portion of the pin is pressed by the bulge portion of the second pressing component to form an circumferentially expended bolt head, thereby the two adjacent chain sections connecting together.

Accordingly, the present invention provides an easier and more convenient way for assembling-disassembling the chain section without damaging the pin and the inner and outer link plates.

The foregoing, as well as additional objects, features and advantages of the present invention will be more readily apparent from the following detailed description, which proceeds with reference to the accompanying drawings.

DESCRIPTION OF THE PREFERRED EMBODIMENT

Figure 1:
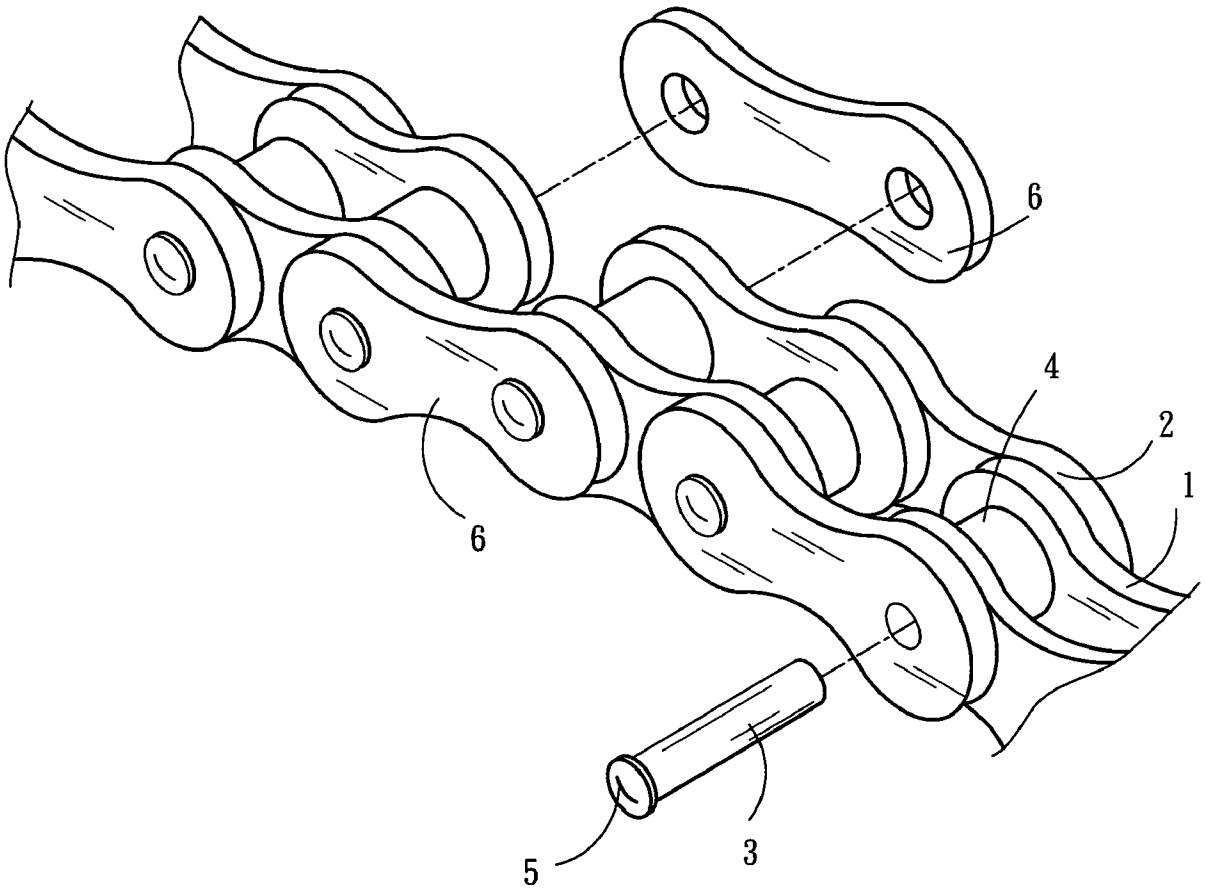
Fig. 1 PRIOR ART
FIG. 1 is a schematic view showing the structure of a chain.
Figure 2:
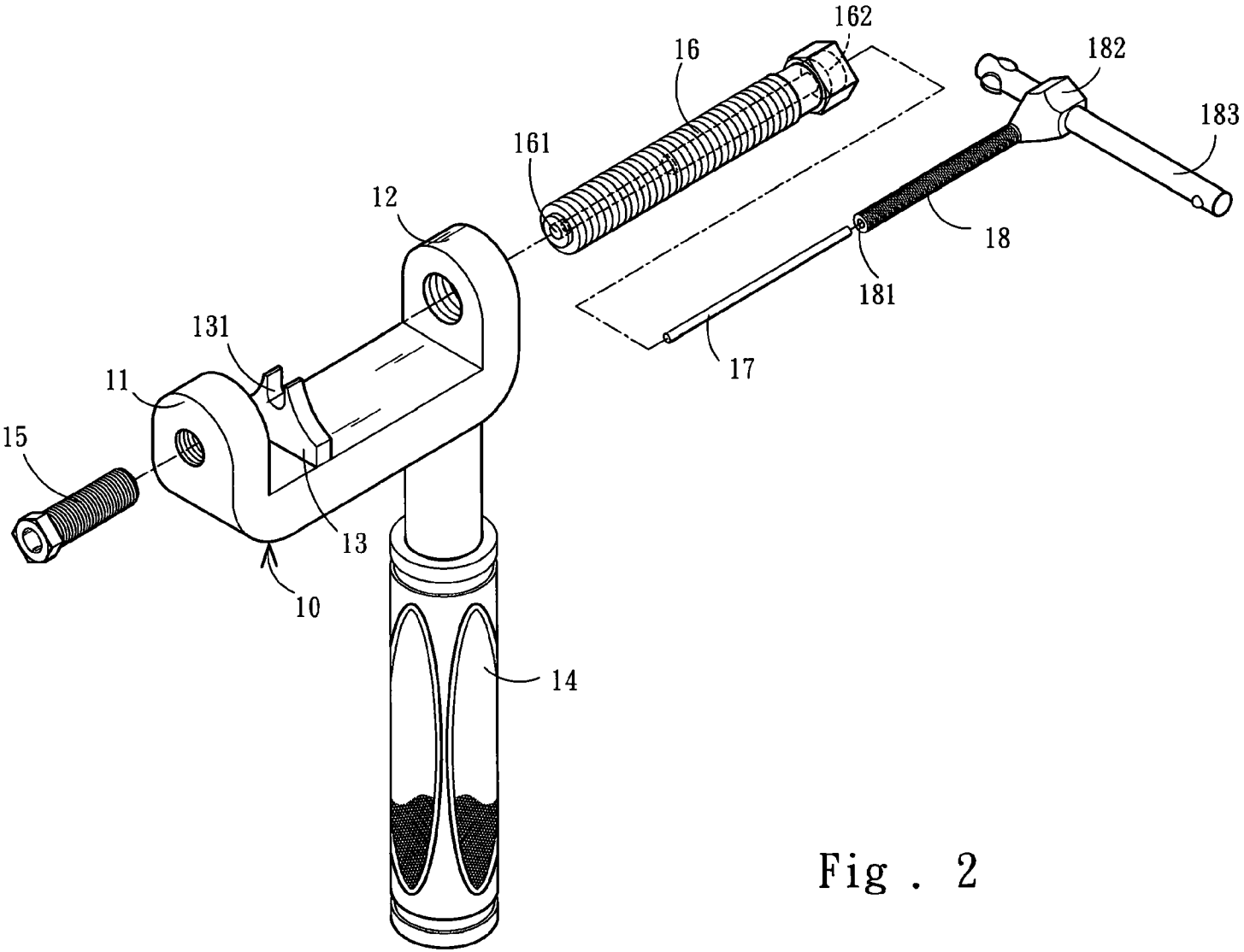
FIG. 2 is a schematic view in a decomposed condition showing an embodiment of the present invention.
Figure 3:
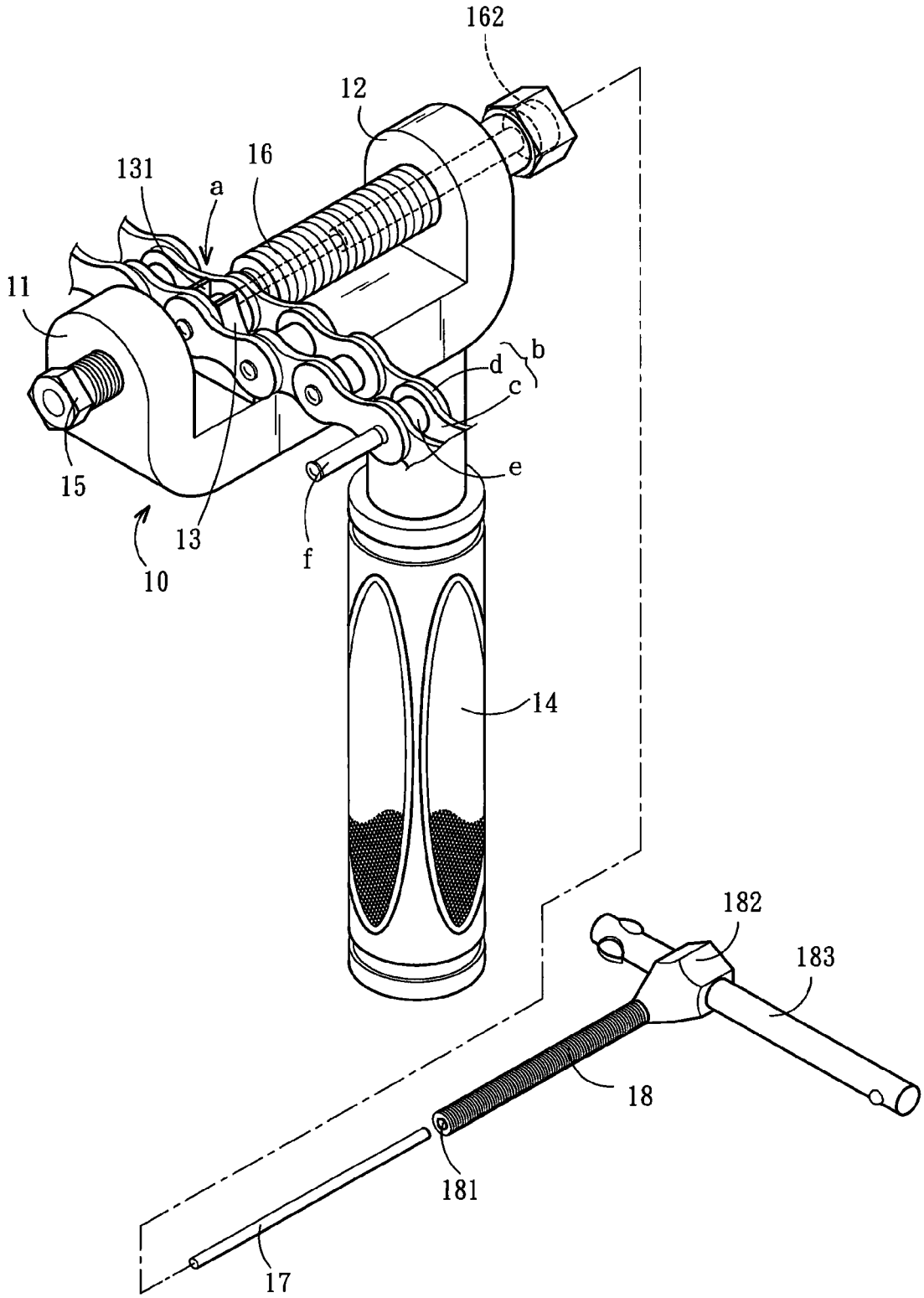
FIG. 3 is a schematic view showing the disassembly of the chain section in an embodiment according to the present invention.
Figure 4:
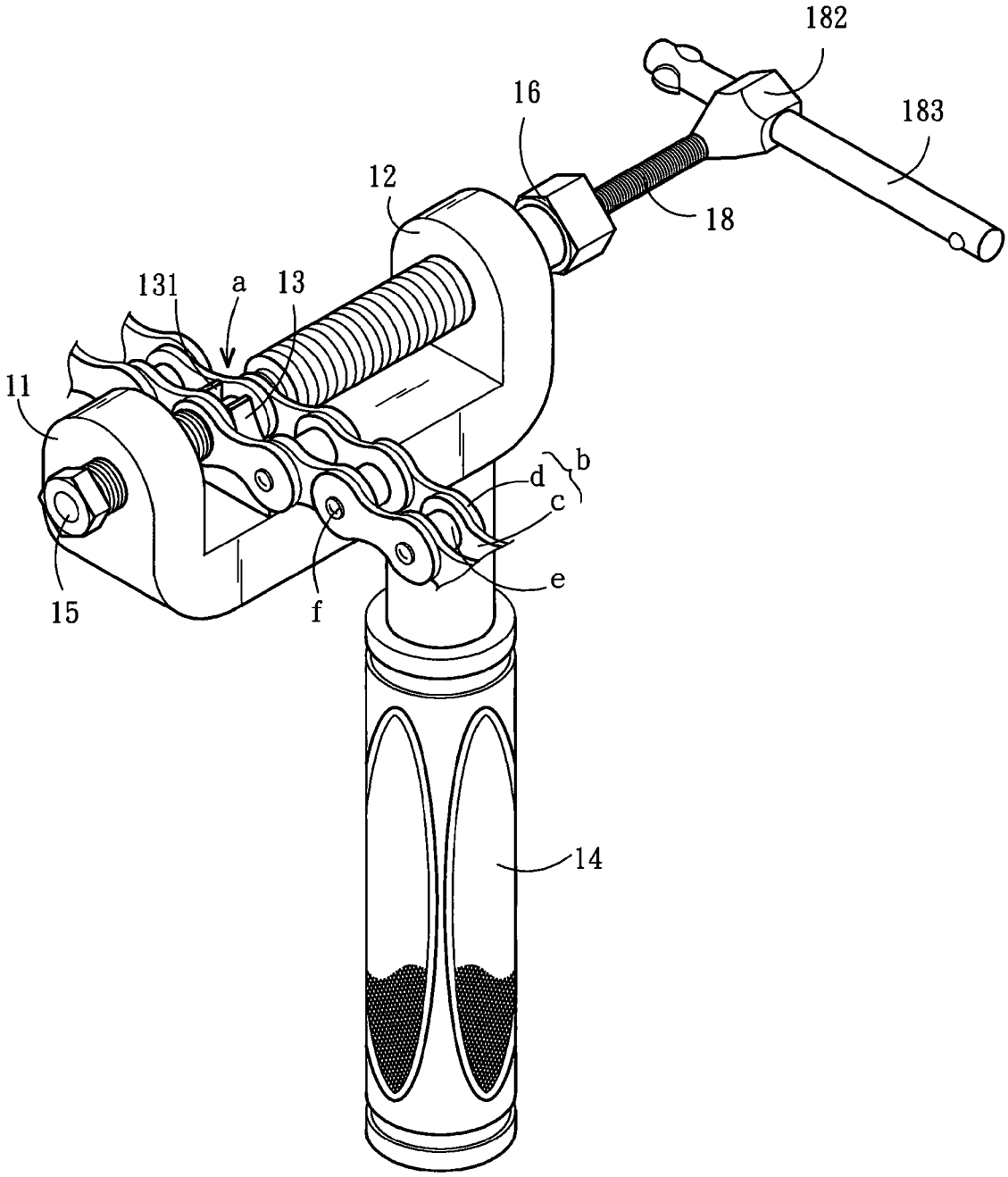
FIG. 4 is another schematic view showing the disassembly of the chain section in an embodiment according to the present invention.
Figure 5A:
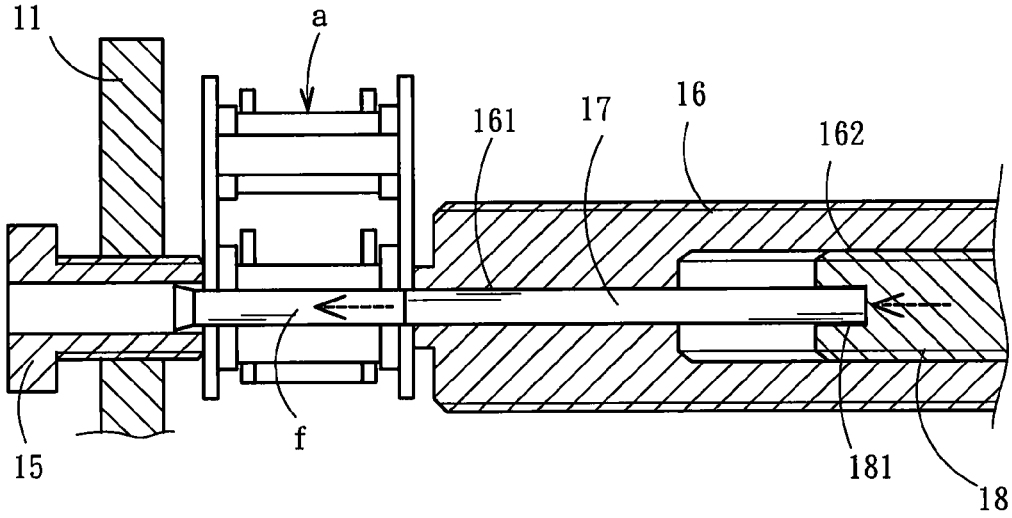
FIG. 5A and FIG. 5B are cross sectional views showing the actions for disassembling the chain section according to the present invention.

Please refer to FIG. 2, FIG. 3 and FIG. 5A. The present invention provides a chain assembling-disassembling structure for disassembling a chain section b of a chain a. The chain section b is composed of a pair of inner link plates c and a pair of outer link plates d. Two bushings e are mounted between the inner link plates c, and a pin f penetrates through the inner link plates c, the outer link plates d and the bushing e for jointing the inner link plates c with the outer link plates d. The chain assembling-disassembling structure includes an assembling base 10, a first clamping component 15, a second clamping component 16, a penetrating shaft 17 and a driving shaft 18.

The assembling base 10 has a horizontal bottom surface with a first portion 11 and a second portion 12 vertically formed at two opposite ends thereof. At the middle of the assembling base 10, a fixing portion 13 of a slice shape is mounted. The fixing portion 13 has a concave edge 131 at the top thereof corresponding to the bushing e, so that the bushing e can be placed on the fixing portion 13 in a transverse direction. Further, a handle 14 is downwardly extended from the bottom of the assembling base 10.

The first clamping component 15 is a screw tube having an inner channel, and is transversely locked with the first portion 11 of the assembling base 10.

The second clamping component 16 is a hollow screw tube transversely locked with the second portion 12 of the assembling base 10 so as to cooperate with the first clamping component 15 for commonly clamping the chain a. Moreover, the second clamping component 16 has a through hole 161 inside and a screw hole 162 formed at the outer side of the through hole 161.

The penetrating shaft 17 penetrates through the through hole 161 of the second clamping component 16. The inner end of the penetrating shaft 17 aims at the outer end portion of the pin 13.

The driving shaft 18 is locked with the screw hole 162 of the second clamping component 16 and presses the outer end of the penetrating shaft 17 via an inner end of the driving shaft 18. The driving shaft 18 has a countersunk hole 181 formed at the inner end thereof for sleeving on the outer end of the penetrating shaft 17, and the outer end of the driving shaft 18 has mounted a head portion 182 for being transversely penetrated by a wrench 183, which is used to provide the user a position to turn the driving shaft 18.

Figure 5B:
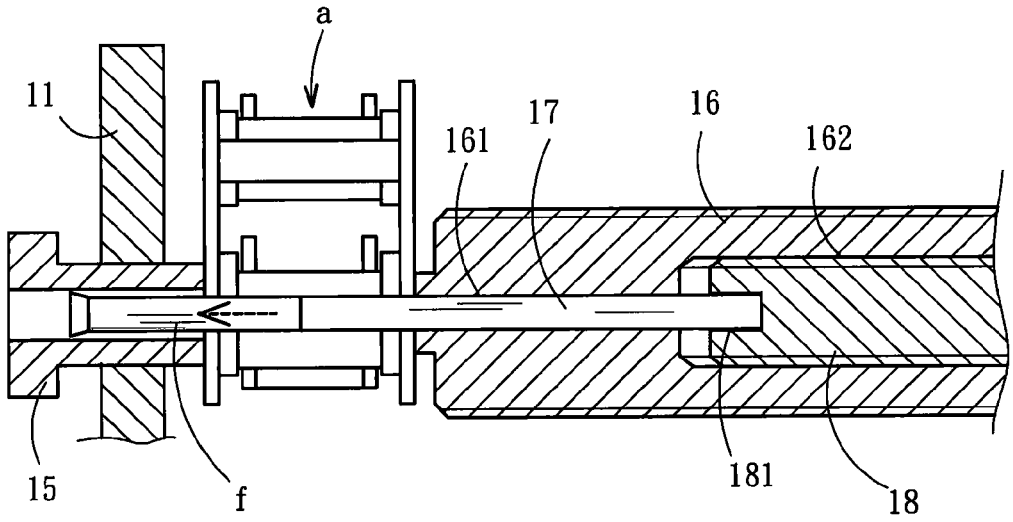

Please refer to FIG. 3 to FIG. 5B. As operating, the handle 14 can be held by one of the user's hands, and the bushing e of the chain a is positioned in the concave edge 131 of the fixing portion 13. The other user's hand can turn the first clamping component 15 and the second clamping component 16 to bi-directionally clamping the chain a therebetween. Then, the penetrating shaft 17 is inserted into the through hole 161 of the second clamping component 16, and the driving shaft 18 is locked in the screw hole 162 of the second clamping component 16. By turning the wrench 183, the driving shaft 18 can be driven to push the penetrating shaft 17 to move inward to press the pin f and thus push out the pin f through the inner channel of the first clamping component 15, as shown in FIG. 5B. Therefore, the pin f for jointing one pair of inner link plates c and one pair of outer link plates d can be pushed out without damaging the pin f and the outer link plates d. And, since the chain a is effectively fixed, the disassembling of the pin f can be achieved more rapidly.

Figure 6:
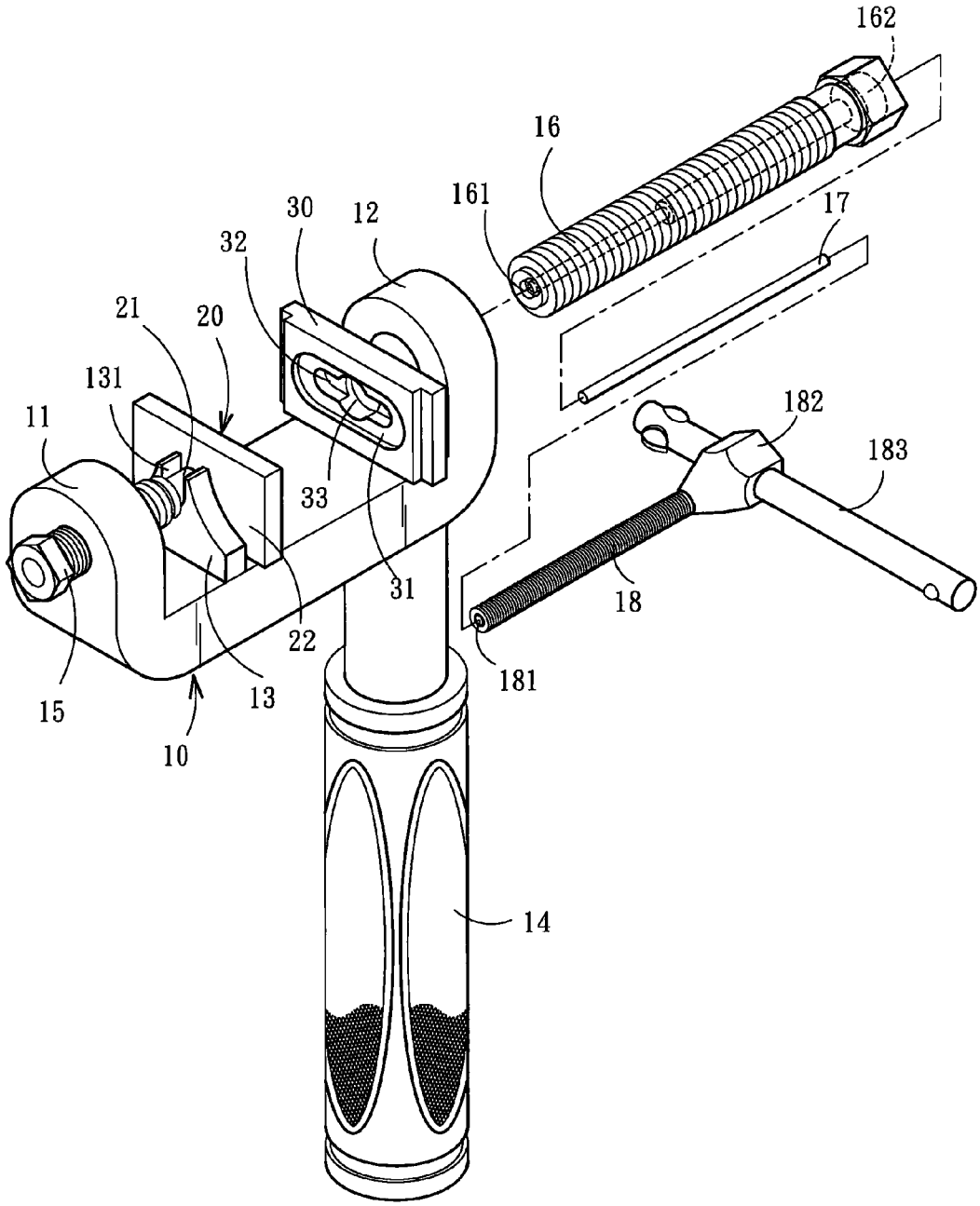
FIG. 6 is a schematic view in a decomposed condition showing the assembly of two chain sections in an embodiment according to the present invention.
Figure 7:
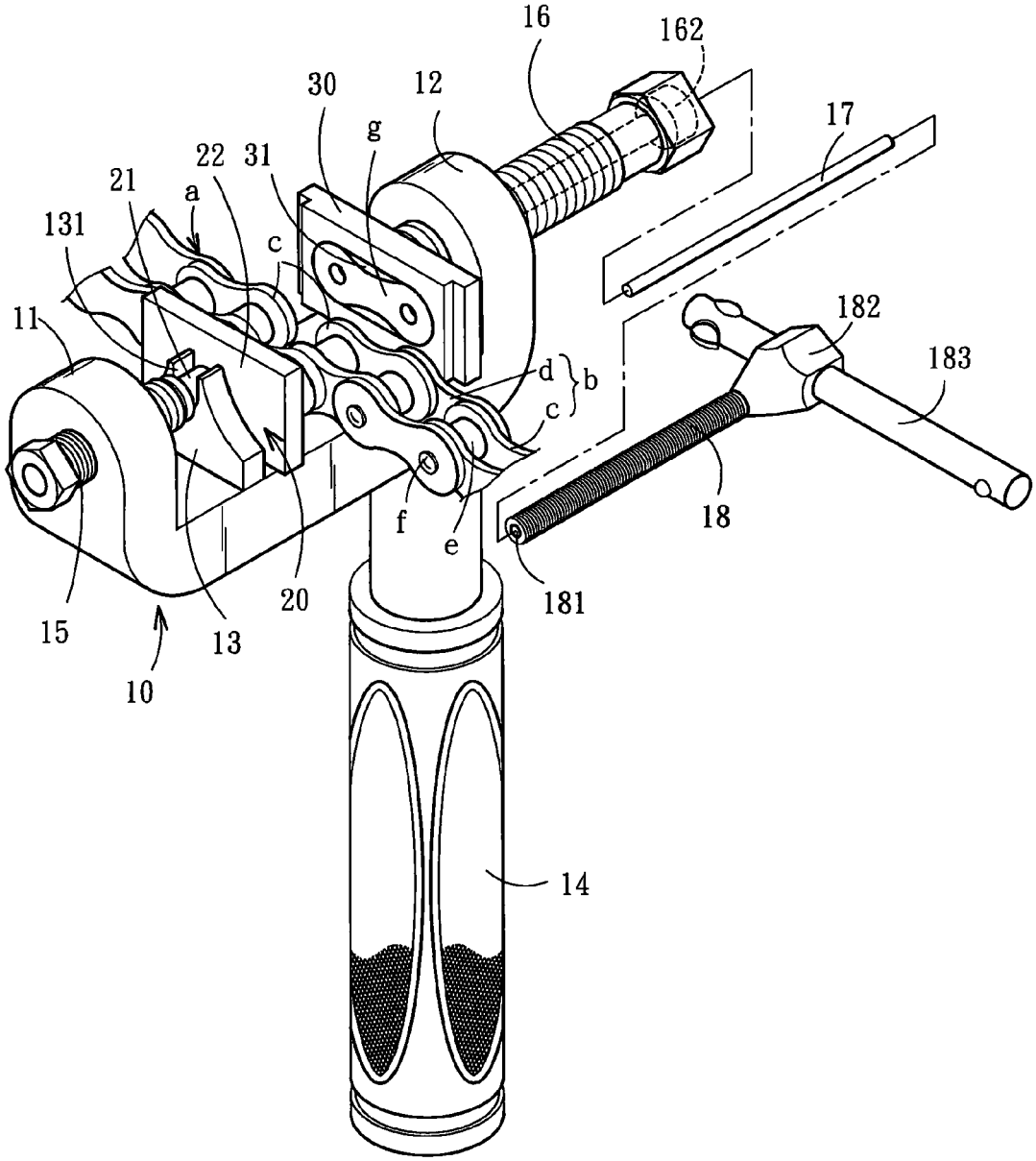
FIG. 7 is a schematic view showing the assembly of two chain sections in an embodiment according to the present invention.
Figure 8:
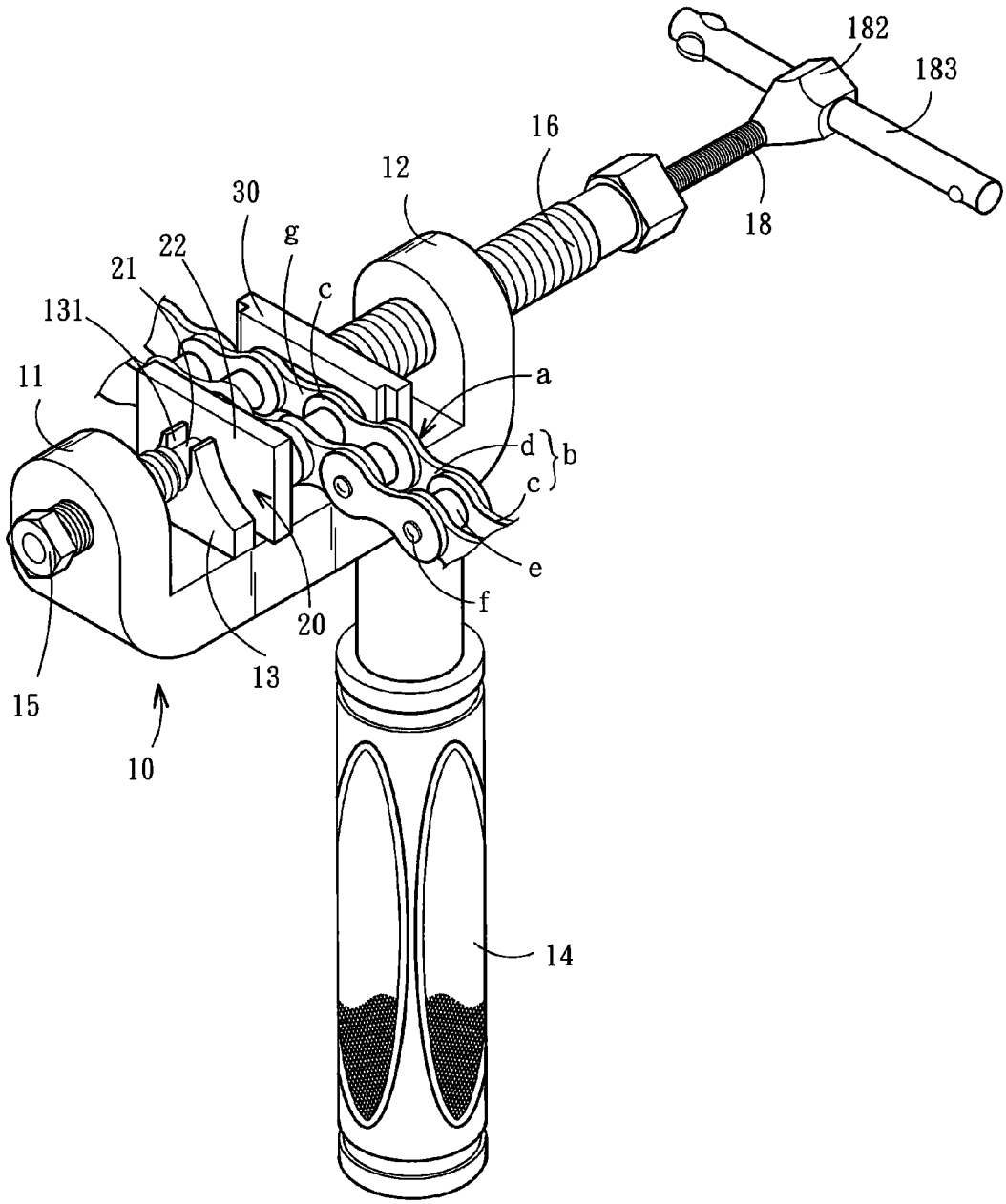
FIG. 8 is another schematic view showing the assembly of two chain sections in an embodiment according to the present invention.

Please further refer to FIG. 6 to FIG. 8. According to the present invention, the chain assembling-disassembling structure for assembling a connecting plate g to the outer surface of the inner link plate c should further includes a third clamping component 20 and a fourth clamping component 30. The third clamping component 20 has a sleeving column 21 formed at one end thereof for being positioned on the concave edge 131 of the fixing portion 13, and a clipping slice 22 formed at the other end thereof. The fourth clamping component 30, which has a slice shape and is opposite to the third clamping component 20, has a frame trough 31 mounted at the inner surface thereof facing the third clamping component 20 for receiving a connecting plate g. The connecting plate g located at the outer surface of the inner link plate c has two pin holes for being penetrated by the pin f, and inside the frame trough 31, a rectangular accommodating depression 32 is further mounted with a hole 33 penetrated by the penetrating shaft 17, so that the inner end of the penetrating shaft 17 can press the connecting plate g to move inward.

Accordingly, when the chain section b is disassembled, and the two adjacent chain sections b are going to be assembled, as shown in FIGS. 6~8, the sleeving column 21 of the third clamping component 20 is positioned in the concave edge 131 and the frame trough 31 of the fourth clamping component 30 accommodates the connecting plate g, so that the chain a can be positioned between the third clamping component 20 and the fourth clamping component 30 and the two adjacent inner link plates c can be just corresponding to the connecting plate g with the pins f of the two inner link plates c corresponding to the pin holes of the connecting plate g. Then, the second clamping component 16 is locked with the second end 12 of the assembling base 10, so that the inner end of the second clamping component 16 can press the fourth clamping component 30 to butt one side of the chain a, and the other side of the chain a can be pressed by the third clamping component. Then, the penetrating shaft 17 penetrates through the through hole 161 of the second clamping component 16, and the driving shaft 18 is locked with the screw hole 162 of the second clamping component 16, so that by turning the wrench 183, the driving shaft 18 can push the penetrating shaft 17 and thus force the inner end of the penetrating shaft 17 to press the fourth clamping component 30, thereby the two pin holes of the connecting plate g sleeving the two pins f of the two adjacent inner link plates c.

Figure 9:
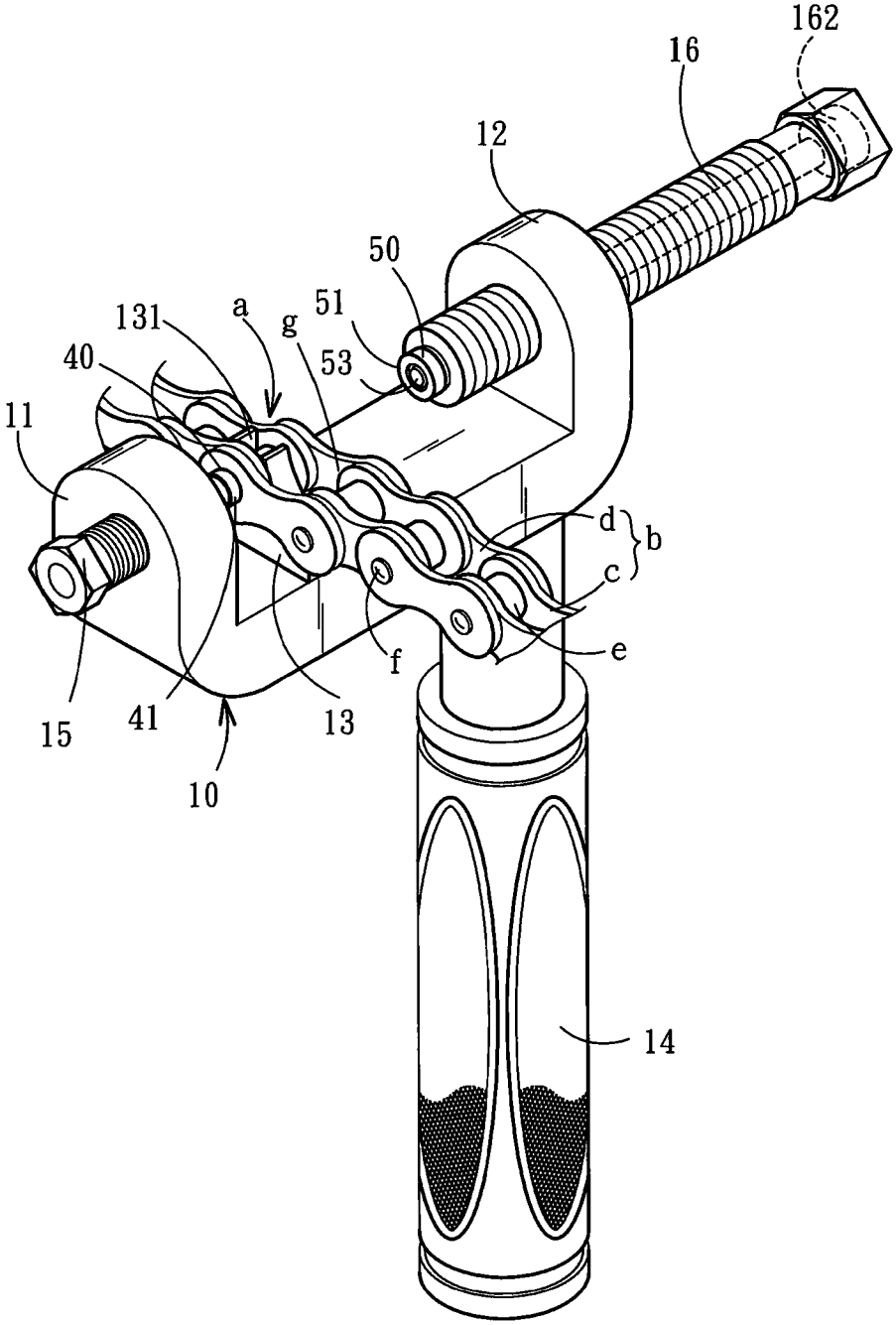
FIG. 9 is a schematic view showing the riveting of the pin according to the present invention.
Figure 10:
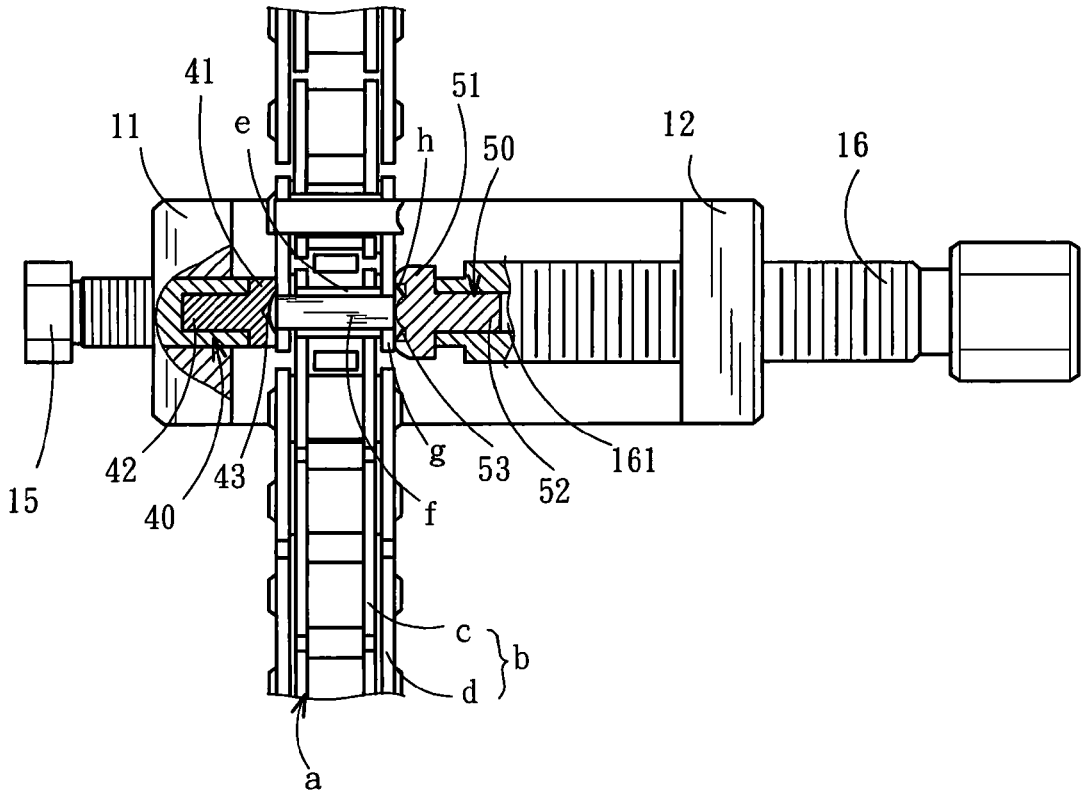
FIG. 10 is a partial cross sectional view showing the riveting of the pin according to the present invention.

Furthermore, please refer to FIG. 9 and FIG. 10. When there is the need to punch the outer end of the pin f into a bolt head, the chain assembling-disassembling structure of the present invention may further includes a first pressing component 40 and a second pressing component 50. The first pressing component 40 has a first pressing head 41 at the inner side thereof and a first column 42 at the outer side thereof. The cross section of the first pressing head 41 is larger than that of the first column 42. The inner side of the first pressing head 41 has a cone-shaped pressing hole, and the first column 42 penetrates the inner channel of the first clamping component 15 from the inner side to the outer side. The second pressing component 50 has a second pressing head 51 at the inner side thereof and a second column 52 at the outer side thereof. The cross section of the second pressing head 51 is larger than that of the second column 52. The inner side of the second pressing head 51 has a bulge portion 53 for pressing the end portion of the pin f to form a bolt head, and the second column 52 penetrates the through hole 161 of the second clamping component 16 from the inner side to the outer side. Thereby the two ends of the pin f are respectively pressed by the pressing hole 43 of the first pressing component 40 and the bulge portion 53 of the second pressing component 50 to form an outwardly extended bolt head h.

Through the structure described above according to the present invention, the concave edge 131 of the fixing portion 13 provides a position for the bushing e in the chain section b, and the second clamping component 16 locked with the second portion 12 of the assembling base 10 cooperates with the first clamping component 15 to clamp the chain a therebetween, so that the penetrating shaft 17 can penetrate through the through hole 161 of the second clamping component 16 and the driving shaft 18 then can lock with the second clamping component 16, so as to push the pin f, which joints the inner and the outer link plates c, d together, thereby disassembling the chain section b without damaging the inner and outer link plates c, d and the pin f.

After the chain section b is disassembled and then the two adjacent chain sections b are going to be reconnected, the inner end of the second clamping component 16 presses the fourth clamping component 30 to butt on the chain a, which is at the same time pressed by the third clamping component 20, so that the connecting plate g can be close to the chain a through the inward movement of the fourth clamping component 30 caused by the second clamping component 16. Then, through turning the wrench 183, the driving shaft 18 can push the penetrating shaft 17 to reject against the connecting plate g, so as to sleeve the pin holes of the connecting plate g on the pins f of the chain section b.

Then, the third clamping component 20 and the fourth clamping component 30 can be taken away for sleeving the first pressing component 40 in the inner channel of the first clamping component 15 and sleeving the second pressing component 50 in the through hole 161 of the second clamping component 16, so that by turning the first clamping component 15 and the second clamping component 16, the two ends of the pin f can be respectively pressed by the pressing hole 43 of the first pressing component 40 and the bulge portion 53 of the second pressing component 50, so as to form an circumferentially expended bolt head h at one end of the pin f, thereby the two adjacent chain sections b connecting together. Therefore, the present invention provides an easier and more convenient way.

In addition, it is also advantageous that the assembling base 10 of the present invention can be assembled with fixing portions 13 of different standards, so as to provide concave edges 131 in different sizes for positioning different bushings e in different chains a, and further, the fourth component 30 also can be varied to adapt to chains a of different standards.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A chain assembling-disassembling structure for assembling-disassembling a chain (a) comprising a plurality of chain sections (b), wherein each of the plurality of chain sections (b) comprises a pair of inner link plates (c) and a pair of outer link plates (d), the pair of outer link plates (d) are disposed on outer sides of the pair of inner link plates (c), the pair of inner link plates (c) are connected via a bushing (e), and a pin (f) penetrates through the pair of inner link plates (c), the pair of outer link plates (d) and the bushing (e) to couple the pair of inner link plates (c) with the pair of outer link plates (d), the chain assembling-disassembling structure comprising:

an assembling base (10), comprising a horizontal bottom surface with a first portion (11) and a second portion (12) vertically formed at two opposite ends of the horizontal bottom surface, and a fixing portion (13) provided at a middle of the horizontal bottom surface of the assembling base (10), wherein the fixing portion (13) comprises a concave edge (131) at a top thereof that is formed corresponding to the bushing (e) so that the bushing (e) is positioned on the fixing portion (13);

a first clamping component (15), which is a screw tube comprising an inner channel and is transversely screwed into the first portion (11) of the assembling base (10);

a second clamping component (16), which is a hollow screw tube transversely screwed into the second portion (12) of the assembling base (10) and comprises a through hole (161) thereinside and a screw hole (162) at an outer side of the through hole (161);

a penetrating shaft (17), penetrating the through hole (161) of the second clamping component (16);

a driving shaft (18), screwing into the screw hole (162) of the second clamping component (16) and pressing the penetrating shaft (17) to move towards the fixing portion (13);

a third clamping component (20), comprising a sleeving column (21) protruded from one side thereof, and a clipping slice (22) located on the same side of the third clamping component (20), wherein the concave edge (131) of the fixing portion (13) is provided to receive one of the bushing (e) and the sleeving column (21);

a fourth clamping component (30), which is formed in a slice shape and located opposite to the third clamping component (20), comprising a frame trough (31) at one side thereof facing the third clamping component (20) to receive a connecting plate (g), wherein the connecting plate (g) is located at an outer side of each of the pair of inner link plates (c) and comprises two pin holes respectively penetrated by the pin (f), the fourth clamping component (30) further comprising an accommodating trough (32) indented from the frame trough (31) with a hole (33) at a center thereof, one end of the penetrating shaft (17) penetrating the hole (33) to press each of the pair of outer link plates (d) to move towards the third clamping component (20);

a first pressing component (40), being connectable with the first clamping component (15) and comprising a first pressing head (41) at an inner side thereof and a first column (42) at an outer side thereof, wherein the first pressing head comprises a notch pressed by one end of the pin (f), and the first clamping component (15) pushes the chain, the sleeving column (21), or the first column (42); and a second pressing component (50), being connectable with the second clamping component (16) and comprising a second pressing head (51) at an outer side thereof and a second column (52) at an inner side thereof, wherein the second pressing head (51) comprises a bulge portion (53) for pressing one end of the pin (f) to form a bolt head (h), and the second clamping component (16) pushes the chain (a), the fourth clamping component (30), or the second column (52).

2. The structure as claimed in claim 1, wherein the driving shaft (18) comprises a countersunk hole (181) at an inner end thereof for receiving the outer end of the penetrating shaft (17).

3. The structure as claimed in claim 1, wherein an outer end of the driving shaft (18) comprises a head portion (182) for being transversely penetrated by a wrench (183).

4. The structure as claimed in claim 1, wherein the horizontal bottom surface of the assembling base (10) is formed to comprise a handle (14) extending downwardly.

5. The structure as claimed in claim 1, wherein a cross section of the first pressing head (41) is larger than that of the first column (42), and a cross section of the second pressing head (51) is larger than that of the second column (52).

6. The structure as claimed in claim 1, wherein the first column (42) is inserted into the inner channel of the first clamping component (15), and the second column (52) is inserted into the through hole (161) of the second clamping component (16).

* * * * *